US005484840A

United States Patent [19]

Binkley

[11] Patent Number: 5,484,840

[45] Date of Patent: Jan. 16, 1996

[54] TEXTILE SIZES CONTAINING ULTRAFINE-SIZED AQUEOUS POLYMERIC DISPERSIONS

[76] Inventor: Jesse A. Binkley, 3770 Jim Owens Rd., NW., Kennesaw, Ga. 30144

[21] Appl. No.: 170,565

[22] Filed: Dec. 21, 1993

[51] Int. Cl.[6] ..... C08J 3/05; C08L 33/08; C08L 33/10; C08L 33/26

[52] U.S. Cl. ..... 524/501; 524/522; 524/523; 524/556; 524/560; 524/561; 524/562; 524/563; 524/564; 524/555; 524/565; 524/524; 524/527; 524/533; 524/567; 524/568; 524/571; 524/577; 526/80; 526/287

[58] Field of Search ..... 524/501, 522, 524/523, 556, 560, 561, 562, 563, 564, 577, 555, 565, 524, 527, 533, 567, 568, 571; 526/80, 287

[56] References Cited

U.S. PATENT DOCUMENTS

| | | | |
|---|---|---|---|
| 3,711,435 | 1/1973 | Hammer et al. | 524/555 |
| 4,177,177 | 12/1979 | Vanderhoff et al. | 524/573 |
| 4,193,902 | 3/1980 | Mondt et al. | 526/80 |
| 4,228,047 | 10/1980 | Pippin et al. | 524/145 |
| 4,522,972 | 6/1985 | Mondt et al. | 524/560 |
| 4,543,387 | 9/1985 | Padget et al. | 524/522 |
| 4,812,510 | 3/1989 | Barnett et al. | 524/814 |
| 5,035,944 | 7/1991 | Frazza et al. | 428/312.4 |
| 5,202,375 | 4/1993 | Biale | 524/562 |
| 5,219,900 | 6/1993 | Davies et al. | 523/201 |
| 5,250,609 | 10/1993 | Kato et al. | 524/461 |

FOREIGN PATENT DOCUMENTS

| | | |
|---|---|---|
| 812139 | 7/1974 | Belgium . |
| 0391343 | 10/1990 | European Pat. Off. . |
| 52-103588 | 8/1977 | Japan . |
| 52-123478 | 10/1977 | Japan . |
| 1100569 | 1/1968 | United Kingdom . |

OTHER PUBLICATIONS

Emulsion Polymerization: Initiation of Polymerization in Monomer Droplets, vol. 11, pp. 503–513 (1973), Author, J. Ugelstad, Polymer Letters Edition.

Polymerization of Oil–in–Water Microemulsions: Polymerization of Styrene and Methyl Methacrylate, vol. 22, pp. 31–38 (1984), Author, A. Jayakrishnan, Polymer Letters Edition.

Polymerized Microemulsions, J. American Chemical Society, vol. 103, No. 14, pp. 4279–4280, Author, S. S. Atik and J. K. Thomas.

Preparation of Asymmetric Polymer Film by Emulsion Blend Technique Colloid and Polymer Science, vol. 268, No. 12 (1990), pp. 1113–1117, Author, M. Okudo, Y. He and K. Ichikawa.

*Primary Examiner*—Peter A. Szekely

*Attorney, Agent, or Firm*—John A. Shedden; Andrew M. Solomon

[57] ABSTRACT

A textile sizing composition comprising one or more aqueous-based dispersions containing between about 15 and about 50 percent by weight solids wherein said solids comprise one or more polymers derived from one or more ethylenically unsaturated monomers, said solids having an average particle size of less than 100 nanometers is disclosed.

4 Claims, No Drawings

TEXTILE SIZES CONTAINING ULTRAFINE-SIZED AQUEOUS POLYMERIC DISPERSIONS

BACKGROUND OF THE INVENTION

1. Field of the Invention

The present invention relates to the use of extremely fine-sized aqueous polymeric dispersions, and particularly acrylic-based dispersions having a mean particle size of less than 60 nanometers as textile sizes. More specifically, the invention comprises the use of two or more fine-size aqueous dispersions which when combined together, optimizes the benefits of each dispersion to yield a final product which may be directly applied to natural and synthetic fibers.

2. Technology Description

Heretofore, numerous emulsion latexes have existed. However, the particle sizes of such latexes have generally been large, for example 120 nanometers or larger. Moreover, the use of ultrafine sized latexes as textile sizing agents has not been appreciated.

U.S. Pat. No. 4,177,177 to Vanderhoff et al relates to various methods for making polymeric emulsions which can be utilized to produce latexes. The latexes generally have a particle size greater than 100 nanometers.

U.S. Pat. No. 4,228,047 to Pippin et al relates to an aqueous coating composition comprising a copolymer of at least 95 percent by weight of vinyl acetate and at least 0.1 percent by weight of maleic anhydride which allegedly has been found to have improved starch binder compatibility.

Japanese Disclosure No. 52103588 to Asahi Dow relates to a carpet-backing composition containing 100 parts by weight (as solids content) of a copolymer latex: 200 to 350 parts by weight of inorganic filler and thickener consisting of 30–60 weight percent of a) butadiene: 20–70 weight percent of b) styrene 5–30 weight percent of c) methyl methacrylate: and 1 to 5 weight percent of d) ethylene series of unsaturated carboxylic acid and has an average particle diameter of 60 to 120 nm. By using the latex of small particle diameter for the carpet backing, blistering is prevented.

Belgian Patent No. 812139 to DeSoto, Inc. relates to opaque coatings obtained from a latex comprised of an aqueous suspension of small and large resin particles, the large particles having a Tg less than the small ones and having an average diameter which is greater than twice that of the small particles, the latter forming 20 to 65 weight percent of the total particles. The particles are such that neither the large nor the small ones can, on their own, coalesce when the latex is dried, to form a non-cellular film. The small particles actually give a powder under such conditions. The small particles are preferably polystyrene and the large ones a copolymer of vinyl acetate and an ester of a 4 to 18 carbon atom alkanol and an unsaturated carboxylic acid. The composition contains a minimum amount of solvent and rapidly gives an opaque coating of low porosity upon drying. It may be used for lipstick, crayons, etc.

British Patent No. 1,100,569 to the Dow Chemical Co. relates to acrylic polymer latexes containing large and small particles prepared by 1) heating water containing a soluble catalyst to up to 85° C. in an inert atmosphere, 2) adding ⅓ of a mixture of monomers, 3) carrying on the polymerization for at least 15 minutes, 4) adding an aqueous solution of an anionic emulsifier and an aqueous solution of the polymerization catalyst, and 5) adding the remaining monomer continuously over a period of at least 45 minutes.

U.S. Pat. No. 3,711,435 to DuPont and Co. relates to a stable, aqueous colloidal dispersion prepared by mixing 1) a copolymer of 20 to 80 weight percent ethylene and 80 to 20 weight percent of an aminoalkylacrylate; 2) an acid having a dissociation constant of 10 to 5; and 3) water in proportion to give a solids containing 5 to 30 weight percent and a degree of neutralization of the amino groups of the polymer of at least 40 percent. The mixing is effected at a temperature suitable for dispersing the polymer in particles of size less than 10 nanometers. The resulting dispersions have very small particle sizes so that they may be thinly spread over aluminum substrates to give void free coatings, and as flocculants for removal of suspended matter from water. N,N-dimethylaminoethylmethacrylate is a suitable comonomer.

Japanese Disclosure No. 52-123478 to Kurraray relates to compositions prepared by emulsion polymerization of unsaturated monomers in the presence of a protective colloid which is prepared by cleaving water-solubilized copolymers in the presence of free radicals and by heating. The compound contains units of maleinimide and/or N-substituted maleinimide and units of alpha-olefin as essential components of the main chain.

An article by Ugelstad, El-Aasser, and Vanderhoff, Journal of Polymer Science, Polymer Letters Edition, 11, 503:1973 relates to the production of latex particles by mini-emulsion polymerization of a mixed-emulsifier system including a surfactant and a long-chain alcohol or alkane cosurfactant utilizing ultrasonification.

An article by Atik and Thomas, Journal of American Chemical Society, 103, 4279: 1981 relates to aqueous styrene polymer microemulsions made by bulk polymerization having a number average particle size of from about 20 to about 35 nanometers by utilizing a mixed emulsifier of cetyl-trimethylammonium bromide and hexanol followed by polymerization with an oil soluble azobisisobutyronitrile and irradiation. However, the solids content was very low, less than 2 percent and the amount of emulsifiers utilized was approximately 1.5 times the amount of polymer by weight.

An article by Jayakrishnan and Shah, Journal of Polymer Science, Polymer Letters, 22, 31 984 relates to a bulk polymerization of polystyrene or methyl methacrylate microemulsion particles having a number average size of from about 10 to about 60 nanometers utilizing sodium dihexylsulfosuccinate and ethylene oxide-propylene oxide block copolymers as mixed-emulsifiers and an oil soluble initiator such as benzoyl peroxide. However, the weight ratio of the emulsifier to the monomer was approximately one to one and the microemulsion could not be diluted with water.

Canadian Patent Application No. 2,013,318, assigned to B. F. Goodrich is directed to a process for producing very fine-sized aqueous polymeric microemulsions. The process utilizes incremental addition of a monomer feed solution into an aqueous solution including one or more emulsifying agents and one or more water soluble or redox initiators. While this method may be used to produce such microemulsions, it is deficient in that the emulsion tends to discolor and that it is extremely difficult to obtain emulsions having a narrow particle size range profile. This reference suggests that the emulsions are suitable for use in paper production as a strength agent or an opacity improver. Other suggested uses include pigment binding, adhesives, binders for clay coatings, nonwoven saturations, textile coatings, beater addition polymers and binders for paint.

An article by Okuba et al, "Preparation of Asymmetric Polymer Film by Emulsion Blend Technique", Colloid & Polymer Science, 268:1113–1117 (1990), teaches blending two different particle size emulsions together to determine the tackiness properties of such blends. One of the starting emulsions disclosed is a poly(ethyl acrylate-methyl methacrylate) emulsion having a particle size of 0.02 microns. According to the article, this emulsion is prepared by combining the monomers in a glass flask with water, sodium sulfite, potassium persulfate and sodium dodecyl sulfate. The order or method of addition of the different reactants, initiators and emulsifiers is not specified.

European Published Patent Application No. 0 429 207, assigned to Rohm & Haas is directed to a method of treating or coating a substrate with an aqueous composition. The coating composition is an aqueous dispersion of copolymer particles having mutually incompatible phases and having an average particle size of about 20 to about 70 nanometers. The dispersion is prepared by emulsion polymerization techniques. In preferred embodiments, the particles are of a core/shell morphology where the core has a $T_g$ of at least 45° C. and the shell has a $T_g$ of lower than 35° C.

In commercial textile sizing operations, a sizing agent is applied to filament yarns to temporarily bind them together. This process inevitably involves applying an acidic material in a first pass to the yarns. Thereafter, the material is then neutralized by the addition of a base. This operation is both costly, as it requires the application of a multiple number of chemicals, and requires action to remove residual base.

Despite the above teachings, there still exists a need in the art for a textile size material derived from one or more ultrafine sized emulsions and which may be directly appled to textile fibers without requiring neutralization with base.

SUMMARY OF THE INVENTION

In accordance with the present invention, a process for using one or more ultrafine sized emulsion latexes which does not discolor, has a narrow particle size distribution, is easily reproducible, and utilizes a minimal amount of surfactant as a textile size is provided. The process is particularly characterized by directly applying the one or more of the ultrafine sized emulsion latexes nanolatices to textile fibers without requiring neutralization of the emulsion latexes before application.

One embodiment of the invention provides a textile sizing composition comprising one or more aqueous-based dispersions containing between about 15 and about 50 percent by weight solids wherein said solids comprise one or more polymers derived from one or more ethylenically unsaturated monomers, said solids having an average particle size of less than 100 nanometers.

A particular preferred embodiment comprises a blend of ultrafine sized dispersions. The polymer of the first dispersion has a glass transition temperature of less than −25° C. and the polymer of the second dispersion has a glass transition temperature of greater than −10° C. Use of the two component system maximizes the benefits of the low glass transition temperature polymer, which is used to glue together filament yarn, while additionally maximizing the benefits of the higher glass transition temperature polymer, which apparently migrates to the outer surfaces of the sizing agent, giving a hard, non-tacky shell.

Another embodiment of the present invention comprises a process for sizing textile fibers comprising the step of applying the above described textile sizing composition to a natural or synthetic textile fiber.

Accordingly, an object of the present invention is to provide a novel textile sizing composition.

Another object of the present invention is to provide a process for applying a novel textile sizing agent to natural or synthetic fibers.

These, as other objects, will readily be apparent to those skilled in the art as reference is made to the detailed description of the preferred embodiment.

DETAILED DESCRIPTION OF THE PREFERRED EMBODIMENT

In describing the preferred embodiment, certain terminology will be utilized for the sake of clarity. Such terminology is intended to encompass the recited embodiment, as well as all technical equivalents which operate in a similar manner for a similar purpose to achieve a similar result.

The ultrafine sized latex textile sizing compositions are preferably produced by incrementally adding one or more ethylenically unsaturated monomers capable of polymerizing in an aqueous environment and incrementally adding a polymerization initiator to a reaction vessel containing water and one or more surfactants and allowing the one or more ethylenically unsaturated monomers to polymerize such that the average particle size of said polymerized monomers is less than 100 nanometers. The term "incremental addition" defines any form of addition of a small amount of the total monomer and/or initiator to the aqueous solution over an extended period of time until all of the monomer and initiator solutions have been added. This includes cyclic additions, interrupted additions, combinations of the above and the like. Preferably, the addition of the monomer and initiator is continuous and at a constant level over a period of time. Any ethylenically unsaturated monomer which is capable of polymerizing in an aqueous environment and potentially useful as a sizing agent may be selected as a starting material. Particularly preferred are any of the following monomers: (meth)acrylic based acids and esters, acrylonitrile, styrene, divinylbenzene, vinyl acetate, ethylenically unsaturated carboxylic acids, acrylamide, methacrylamide, vinylidene chloride, butadiene and vinyl chloride. The dispersion solids that are produced may take the form of homopolymers (i.e., only one type of monomer selected) or copolymers (i.e., mixtures of two or more types of monomer are selected; this specifically includes terpolymers and polymers derived from four or more monomers).

Most preferred are the use of acrylic based acids and esters. The acrylic polymers of the present invention are derived from one or more acrylate monomers having the formula $$H_2C{=}\overset{\overset{R_1}{|}}{C}{-}\overset{\overset{O}{||}}{C}{-}OR_2 \qquad (I)$$

where $R_1$ is preferably hydrogen or an alkyl group having from 1 to 4 carbon atoms and $R_2$ is hydrogen or an aliphatic group having from 1 to 20 carbon atoms. In most preferred embodiments, $R_1$ comprises a methyl group and $R_2$ is an alkyl group having from 1 to 20 carbon atoms.

Specifically useful monomers falling within the scope of formula (I) include methyl methacrylate, ethyl acrylate, butyl acrylate, methacrylic acid, acrylic acid and mixtures thereof.

Other monomers or starting compounds which may be utilized to produce ultrafine sized latexes are well known to the art. Examples are set forth in The Encyclopedia of Chemical Technology, Kirk-Othmer, John Wiley & Sons, Vol. 14, pp 82–97, (1981). To the extent necessary, this passage is hereby incorporated by reference.

When producing copolymers that are in part derived from acrylic monomers, the amount of acrylic monomer typically ranges from about 30 to about 99 percent of the total amount of monomers, with amounts ranging from about 50 to about 90 percent being more preferred, and amounts ranging from about 60 to about 80 percent being most preferred. In addition, when copolymerizing with an acid, such as methacrylic acid, the copolymer may include up to 60 weight percent of acid. This is much higher than prior art systems which were limited to no more than 25% methacrylic acid and enables the latexes to be particularly useful as the resulting materials are easier to dissolve in base. Further, when producing copolymer dispersions, the separate monomers may be fed to the aqueous reaction medium from either the same or different feed vessels.

In accordance with a particularly preferred embodiment of the present invention, the production of a novel textile sizing agent composition derived from two ultrafine dispersions is specifically provided. Such a composition comprises a mixture of two aqueous-based dispersions where the glass transition temperature of the polymer of the first dispersion is less than −25° C., more preferably less than −35° C. and the glass transition temperature of the polymer of the second dispersion is greater than −10° C. and preferably less than 130° C., more preferably less than 60° C. In preferred embodiments, the respective weight amounts of the first dispersion to the second dispersion ranges from about 30:70 to about 90:10. Further, in accordance with a specifically preferred embodiment, the solids of the first dispersion are derived from butyl acrylate and acrylic acid and other acrylate, methacrylic and vinyl monomers which are polymerizable via free radical initiation; while the solids of the second dispersion are derived from methyl methacrylate and methacrylic acid and other acrylate, methacrylic and vinyl monomers which are polymerizable via free radical initiation. However, almost any polymer blend can be used; the key criteria being the difference in the glass transition temperature of the respective polymers.

Under this arrangement the softer (low glass transition temperature) polymer is used to glue together filament yarns while at the same time the harder (higher glass transition temperature) polymer is used as a migratory additive (detacking agent) that can eliminate surface tackiness and blocking associated with the soft polymer. During the sizing operation, the softer polymer forms "spot-welds" between the yarn fibers whereas the harder polymer apparently migrates to the outer surfaces of the "spot-welds", giving a hard, non-tacky shell. Also within the scope of this invention is the combination of a ultrafine sized latex with a conventional sized latex (>100 nm) for use as a textile sizing agent.

While not necessary, it may be desirable that the polymers produced be cross-linked. This is accomplished by adding one or more cross-linking agents to the reaction medium. Examples of cross linking agent include monofunctional compounds such as N-alkylol amides of the formula

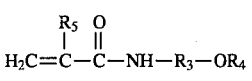

where $R_3$ is an alkyl group having from 1 to 10 carbon atoms, preferably from 1 to 4 carbon atoms; $R_4$ is hydrogen or an alkyl group having from 1 to 10 carbon atoms, preferably from 1 to 4 carbon atoms; and $R_5$ is hydrogen or an alkyl group having from 1 to 4 carbon atoms. Specific examples of suitable cross-linking agents include N-methylol acrylamide, N-ethanol acrylamide, N-propanol acrylamide, N-methylol maleimide, N-ethylol maleamide, N-methylol maleamic acid, N-methylol maleamic acid esters, the N-alkylol amides of the vinyl aromatic acids such as N-methylol-p-vinyl benzamide, and the like. Another useful cross-linking agent is N-(isobutoxymethyl) acrylamide.

Various difunctional compounds or monomers can also be utilized as effective cross-linking agents. These include compounds containing two olefinic groups such as divinylbenzene, divinylnaphthalene, divinylcyclohexane, and the like; various diacrylate or dimethacrylate esters of aliphatic diols where the ester portion has from 1 to 10 carbon atoms, and is preferably alkyl where the diol portion has from 2 to 8 carbon atoms. Examples of these materials include ethylene glycol dimethacrylate, diethylene glycol diacrylate, diethylene glycol dimethacrylate and butylene glycol.

Other cross-linking agents are described in the Journal of Applied Polymer Science, Vol. 34, pp 2389–2397 (1987) John Wiley & Sons, Inc., in an article entitled "New Cross-Linking Agents for Vinyl Polymers". To the extent necessary, this article is hereby fully incorporated by reference.

The amount of the cross linking agent when utilized is generally from about 0.05 to about 10 percent by weight, desirably from about 0.1 to about 5 percent by weight, and most preferably from about 0.1 to about 1.0 percent by weight based upon the total weight of all monomers added.

Also incrementally added to the aqueous reaction medium is one or more polymerization initiators, preferably a free radical thermal initiator. The polymerization initiator may take the form of many known initiators such as azo, peroxide, persulfate and perester initiators and may be either water soluble or monomer soluble. The amount of initiator added to the solution typically ranges from between about 0.05 to about 2 weight percent of the emulsion with amounts ranging from about 0.1 to about 1.0 weight percent being particularly preferred and amounts ranging from about 0.1 to about 0.5 weight percent being most preferred. The free radical initiator added is preferably an azo (azobisnitrile) type initiator (water or oil soluble) such as 2,2'-azobisisobutyronitrile, 2,2'-azobis-(2-methylpropanenitrile), 2,2'-azobis-(2,4-dimethylpentanenitrile), 2,2'-azobis-(2-methylbutanenitrile), 1,1'-azobis-(cyclohexanecarbonitrile), 2,2'-azobis-(2,4-dimethyl-4-methoxyvaleronitrile), 2,2'-azobis-(2,4-dimethylvaleronitrile) and 2,2'-azobis-(2-amidinopropane) hydrochloride.

Other free radical initiators which may be selected include peroxide materials such as benzoyl peroxide, cumene hydroperoxide, hydrogen peroxide, acetyl peroxide, lauroyl peroxide, persulfate materials such as ammonium persulfate, and peresters such as t-butylperoxypivalate, α-cumylperoxypivalate and t-butylperoctoate.

Examples of commercially suitable initiators which may be selected include Wako V-50, Vazo 52, Vazo 64, Vazo 67 and Lupersol 11. These commercial initiators may be included with the monomer feed.

In the case of water soluble initiators, such as the peroxides and persulfates, it is preferred that during polymerization the ionicity of the reaction medium be maintained at a constant. This is accomplished by removing a portion of the water from the aqueous reaction medium and adding this removed water to the initiator feed stream. The need for maintaining a constant ionicity is seen when attempting a conventional post treatment for residual monomer with ammonium persulfate and sodium metabisulfite. Large quantities of coagulum form, reducing the efficacy of the process. Similarly, a conventional initiator feed consisting of ammonium persulfate and 1–3 weight percent of the total water volume will cause agglomeration of polymer particles throughout the initiator addition.

It has been found that by maintaining a constant ionicity in the reaction mixture, agglomeration can be avoided, yielding a more uniform particle size emulsion. By diluting the water soluble initiator with the proper quantity of water, the ionic strength of the initiator system will be the same as the contents of the reaction vessel at any time during the reaction/initiator feed. Presumably, this matched ionicity (as expressed in the number of charges per volume) allows the diffusion controlled migration of charged species such as ammonium persulfate and ionic surfactants from droplet to reaction mixture or vice versa.

Use of highly concentrated initiator solutions presumably allows large changes in the ionic concentration in the area immediately surrounding an initiator droplet. It is hypothesized that this massive change in charge density overwhelms the stabilizing forces exerted on the particles by surfactant and initiator residues.

The same ionic balance can be achieved by careful selection of a charge neutral monomer soluble initiator such as the azo type initiator commercially sold as VAZO 52 (2,2'-azobis-(2,4-dimethylvaleronitrile)) or VAZO 64 (2,2'-azobis-isobutyronitrile). In these cases, the entire quantity of initiator is contained within the monomer feed.

In accordance with the process of the present invention, to produce the novel textile sizing compositions the monomer(s) and initiator(s) are fed into an aqueous reaction medium which comprises water and at least one or more emulsifiers. The emulsifiers are generally surfactants and hence can be cationic, nonionic, anionic, amphoteric, copolymerizable surfactants and the like with anionic generally being desired. Generally, the type of emulsifiers utilized are those which can be utilized in conventional latex polymerizations. As is recognized by one skilled in the art, a key criteria for selecting a surfactant is its compatibility with the initiator.

Examples of suitable amphoteric surfactants include the alkali metal, alkaline earth metal, ammonium or substituted ammonium salts of alkyl amphocarboxy glycinates and alkyl amphocarboxypropionates, alkyl amphodipropionates, alkyl amphodiacetates, alkyl amphoglycinates and alkyl amphopropionates wherein alkyl represents an alkyl group having 6 to 20 carbon atoms. Other suitable amphoteric surfactants include alkyliminopropionates, alkyl iminodipropionates and alkyl amphopropylsulfonates having between 12 and 18 carbon atoms, alkylbetaines and amidopropylbetaines and alkylsultaines and alkylamidopropylhydroxy sultaines wherein alkyl represents an alkyl group having 6 to 20 carbon atoms.

Anionic surfactants which may be selected include any of the known hydrophobes attached to a carboxylate, sulfonate, sulfate or phosphate solubilizing group including salts. Salts may be the sodium, potassium, calcium, magnesium, barium, iron, ammonium and amine salts of such surfactants.

Examples of such anionic surfactants include water soluble salts of alkyl benzene sulfonates having between 8 and 22 carbon atoms in the alkyl group, alkyl ether sulfates having between 8 and 22 carbon atoms in the alkyl group, alkali metal, ammonium and alkanolammonium salts or organic sulfuric reaction products having in their molecular structure an alkyl, or alkaryl group containing from 8 to 22 carbon atoms and a sulfonic or sulfuric acid ester group.

Preferred are linear sodium and potassium alkyl sulfates. Particularly preferred is the use of sodium lauryl sulfate (sodium dodecyl sulfate). Another preferred type of anionic surfactant are alkyl benzene sulfonates, in which the alkyl group contains between about 9 to about 15, and even more preferably, between about 11 to about 13 carbon atoms in a straight chain or branched chain configuration and even most preferred a linear straight chain having an average alkyl group of about 11 carbon atoms.

In some embodiments, mixtures of anionic surfactants may be utilized, with mixtures of alkyl or alkylaryl sulfonate and sulfate surfactants being especially preferred. Such embodiments comprise a mixture of alkali metal salts, preferably sodium salts, of alkyl benzene sulfonates having from about 9 to 15, and more preferred between 11 and 13 carbon atoms with an alkali metal salt, preferably sodium, of an alkyl sulfate or alkyl ethoxy sulfate having 10 to 20 and preferably 12 to 18 carbon atoms and an average ethoxylation of 2 to 4.

Specific anionic surfactants which may be selected include linear alkyl benzene sulfonates such as dodecylbenzene sulfonate, decylbenzene sulfonate, undecylbenzene sulfonate, tridecylbenzene sulfonate, nonylbenzene sulfonate and the sodium, potassium, ammonium, triethanolammonium and isopropylammonium salts thereof.

Examples of useful nonionic surfactants include condensates of ethylene oxide with a hydrophobic moiety which has an average hydrophilic lipophilic balance (HLB) between about 8 to about 16, and more preferably, between about 10 and about 12.5. These surfactants include the condensation products of primary or secondary aliphatic alcohols having from about 8 to about 24 carbon atoms, in either straight or branched chain configuration, with from about 2 to about 40, and preferably between about 2 and about 9 moles of ethylene oxide per mole of alcohol.

Other suitable nonionic surfactants include the condensation products of about 6 to about 12 carbon atom alkyl phenols with about 3 to about 30, and preferably between about 5 and about 14 moles of ethylene oxide. Examples of such surfactants are sold under the trade names Igepol CO 530, Igepol CO 630, Igepol CO 720 and Igepol CO 730 by Rhone-Poulenc Inc. Still other suitable nonionic surfactants are described in U.S. Pat. No. 3,976,586. To the extent necessary, this patent is expressly incorporated by reference.

Examples of cationic surfactants include cetyl trimethyl ammonium bromide.

Other surfactants which may be used include those described in McCutcheons, "Detergents and Emulsifiers," 1978 North American, Edition, Published by McCutcheon's Division, MC Publishing Corp., Glen Rock, N.J., UESTA., as well as the various subsequent editions. To the extent necessary, this reference is expressly incorporated by reference.

In practice the amount of surfactant present in the aqueous phase ranges between about 0.5 to about 6.3 percent by weight of the monomers added. Amounts between about 0.5 and about 3.0 percent by weight of the total monomers added are more preferred and amounts between about 1.0 and about 3.0 percent by weight of the total monomers added are most preferred. In general, the particle size of the latex decreases with increasing amounts of surfactant added up to about 3.0 weight percent. Beyond 3.0 weight percent surfactant, the decrease in particle size is far less pronounced.

The reaction medium can include between about 0.5 to about 10.0 percent by weight of the monomers added of other optional additives to provide specific functional properties to the final latex. Examples of such additives include plasticizers such as polyethylene glycol, defoamers, pigments, colorants, dyes, and antibacterials.

To produce the novel textile sizing latexes of the present invention a semi-continuous or continuous polymerization process is utilized. This involves adding the monomer, including cross-linking agent if necessary and initiator solutions incrementally to the reaction vessel, which is typically heated to temperatures between about 45° C. and about 90° C. and includes water and one or more emulsifiers over a period of time as opposed to a batchwise addition. Optionally, the reaction vessel can contain a small amount of monomer before commencement of the incremental polymerization to act as a "seed". Such a small amount of monomer is generally below 30 percent by weight and desirably no more than about 10 percent by weight of the total monomer utilized. The rate of the monomer addition is generally governed by various factors such as reaction vessel size, exothermic reaction temperature increase, cooling capacity of the reaction vessel, and the like, such that the reaction temperature is generally maintained at a specific value or range.

The amount of the one or more emulsifiers generally contained in the reaction vessel is generally at least 50 or 60 percent by weight, desirably at least 70 percent by weight, more desirably at least 80 percent by weight, and preferably at least 90 percent by weight of the total amount of emulsifiers. The remaining emulsifier, if any, is fed with either the monomer or initiator feed streams.

The reaction vessel may be maintained at temperatures as low as ambient temperatures (10° C. to 20°) up to the boiling point of the aqueous solution. The reaction pressure is generally atmospheric, but may be elevated if necessary to assist in polymerization.

As discussed above, the monomer feed and the initiator feed may be the same feed if the initiator is monomer soluble. Further, if the initiator is water soluble and charged, such as ammonium persulfate, it is fed such that the ionicity throughout the reaction vessel is maintained at a constant. This is typically accomplished by initially transferring an amount of the water from the reaction vessel to the initiator feed to create ionic concentrations in both the feed vessel and the reaction vessel which are substantially equal.

Feeding the initiator solution on an incremental basis provides for a generally steady state free radical concentration throughout the monomer addition. This steady state free radical concentration avoids the low radical concentrations seen with single charges of initiators and prolonged feed times. It is this continual and ready availability of free radicals that allows new chain and particle formation to compete effectively with addition of monomer to existing particles. As compared to so-called single shot initiator feed systems, the inventive process markedly improves the monodispersity of the resulting latex.

Polymerization continues until all of the monomer(s) and initiator has been added into the reaction vessel and until nearly all of the monomer feed has been converted to a polymerized form. Polymerization is generally continued until a high conversion is achieved as in excess of 80 percent, desirably at least 90 or 95 percent, and preferably at least 98 percent or even complete conversion.

Regardless of the particular type of monomers selected for polymerization in the process as set forth above, the polymer average particle size is very small. By the term "particle size" it is meant the volume average median particle size as measured by photocorellation spectroscopy. Polymeric latexes produced according to the present invention have a very small volume average particle size of 100 nanometers of less, with average preferred particle sizes of between about 1 and about 60 nanometers, more preferred between about 5 and about 40 nanometers, still more preferred between about 10 and about 30 nanometers, and ideally between about 10 and about 20 nanometers. Generally, any of the above particle size ranges can be produced depending upon the specific end properties desired.

Further, and particularly because of the incremental initiator feed system used, the range of the produced particle size range is limited. In practice the standard deviation for each desired size latex is no more than 4 nanometers.

The above process yields a polymeric latex which is coagulation stable inasmuch as it can be diluted with water without coagulation occurring. The solids content of the latex is relatively high as from about 5 percent to about 55 percent by weight, desirably from about 15 percent to about 50 percent by weight, more preferably from about 20 to about 40 percent by weight, and most preferably from about 25 to about 35 percent by weight based upon the total weight of the aqueous polymeric latex.

To utilize the inventive aqueous dispersion as textile sizing compositions, the compositions are simply applied to textile fibers. Examples of textile fibers is meant to include polyamide fibers such as Nylon 6, Nylon 66 and Nylon 610; polyester fibers such as Dacron, Fotrel and Kodel; acrylic fibers such as Acrolan, Orlon and Creslan; modacrylic fibers such as Verel and Dynel; polyolefinic fibers such as polyethylene and polypropylene; cellulose ester fibers such as Arnel and Acele; polyvinyl alcohol fibers; natural fibers such as cotton and wool, manmade cellulosic fibers such as rayon and regenerated cellulose; and the like.

Application of the sizing compositions to the fibers is typically accomplished by means known in the art. For example, yarn samples are prepared via slashing (sizing) on a bench-top slasher in which the yarn is drawn through a bath containing the size at concentrations ranging from 0–15 wt % and subsequently drawn across a series of driven, heated rollers. The dried yarn is then conditioned for a minimum of 24 hours prior to evaluation. Evaluations consist of, but are not limited to, comparative tests of: yarn stiffness, abrasion resistance, and filament bundle integrity upon yarn breakage. No matter what coating method is utilized to apply the composition to the textile fibers, no neutralization step is necessary. This provides a significant cost and environmental advantage as compared to prior art sizing materials.

For use as textile sizing compositions it is particularly desired that the average molecular weight of the polymers of the one or more emulsions be controlled depending on the monomer(s) selected. If the molecular weight is too high, the emulsions may not be ideal sizing agents as high molecular weight lead to poor removal of the size from the yarn. Maintenance of the desired molecular weight profile may be accomplished by adding a chain transfer agent, such as N-dodecylmercaptan to the emulsion. The amount of chain transfer agent added typically ranges between about 0.1 and about 1.5 parts per hundred parts monomer added.

Further advantages of utilizing the inventive sizing materials include preferred molecular weight with low viscosity; good water resistance; no need for dissolution; better overall sizing due to the particles acting like a weld; and versatility.

The invention will be better understood by reference to the following examples.

EXAMPLE 1

To a solution containing 3.1 parts per hundred monomer (PHM) sodium lauryl sulfate and 245 PHM water heated to 85° C. are added continuously and simultaneously two separate feeds. One feed is comprised of 0.32 PHM ammonium persulfate dissolved in 85 PHM of water and the other feed is comprised of 10 PHM of styrene, 25 PHM methacrylic acid, and 65 PHM butyl acrylate and 0.5 PHM N-dodecylmercaptan. Addition of each separate feed occurs for approximately 2.5 hours and each feed stream is metered into the reaction vessel in such a way that both feed streams are completed depleted after approximately 2–5 hours. A solution containing 0.1 PHM sodium metabisulfite dissolved in 24 PHM water is then metered into the reaction mixture over an interval of ½ hour. The temperature is maintained for 1 hour and the reaction mixture is subsequently cooled to room temperature and is filtered. A blue-clear latex is yielded having a solids level of 23.3% and an average particle size of about 14 nanometers. The $T_g$ of this latex is −5.3° C.

EXAMPLE 2

To a mixture maintained at 85° C. and containing 8 g of sodium lauryl sulfate and 800 g of $H_2O$ are added 0.81 g ammonium persulfate dissolved in 2 g $H_2O$, and then, continuously, a monomer solution containing 149.6 g methyl methacrylate, 38.7 g methylacrylic acid, 69.6 g butyl acrylate and 4.0 g N-dodecylmercaptan. Following completion of the monomer addition a solution of 0.12 g ammonium persulfate dissolved in 31 g $H_2O$ is added. This is followed by the addition of 0.12 g sodium metabisulfite dissolved in 31 g $H_2O$. Following addition of this redox system the temperature is raised to 95° C. and 1.0 g of $H_2O_2$ (35%) is added to the mixture. The solution is heated for an additional 1 hour then cooled to room temperature. The calculated $T_g$ of the resulting ultrafine sized latex is +52.9° C. The particle size of this latex is 25 nanometers.

Samples of this emulsion are cast on mylar substrates and allowed to air dry. They are then evaluated at 45% and 75% relative humidity. Films are also heat set at 200° C. for 35 seconds to determine resolubility temperature. 150 Denier/48 filament polyester yarn is sized with this composition without the prior addition of a neutralizing agent to the composition. For use as a comparison, commercially available products, which must be neutralized prior to application, are also tested.

The inventive emulsion films give good adhesion to the mylar substrate but appear to be tougher and more brittle than the neutralized versions even at higher humidity. Heat set solubility is 175° to 180° F., about 10° F. higher then the neutralized version. This is not unusual with an unneutralized product. The inventive polymer is used at 10% concentration to size the polyester yarn. The polymer gives good adhesion to the yarn. The water resistance of the inventive polymer may be particularly advantageous for use on waterjet looms.

EXAMPLE 3

To a solution containing 3.1 PHM sodium lauryl sulfate, 0.3 PHM TDET 9.5 (a nonionic surfactant) and 283 PHM water heated to 85° C. is added 0.83 g ammonium persulfate dissolved in 2 g water. To this mixture is continuously added over an interval of about 2.5 hours a feed comprised of 90 PHM butyl acrylate, 10 PHM acrylic acid and 1 PHM N-dodecyl mercaptan. A solution containing 0.046 PHM ammonium persulfate and 9.3 PHM water is then metered into the reaction mixture over an interval of five minutes. To the resulting mixture is added a solution containing 0.046 PHM sodium metabisulfate and 9.3 PHM water over a five minute interval. The mixture is then heated to 95° C. and a solution containing 1.16 PHM $H_2O_2$ (35 wt %) is added. The temperature is maintained for 1 hour and the reaction mixture is subsequently cooled to room temperature and is filtered. A blue-clear latex is yielded having a solids level of 25.2 wt % and a particle size of 35 nanometers. Its $T_g$ is −44° C.

EXAMPLE 4

Between about 10 and about 70 parts of the latexes of either Examples 1 or 2 are mixed with between about 90 and about 30 parts of the latex of Example 3. These blend compositions are applied to filament yarns using known conditions for functioning as a textile size. The polymer of Example 3 functions to glue together the filament yarns while at the same time the polymers of Examples 1 or 2 function as migratory additives that can eliminate surface tackiness and blocking associated with the polymer of Example 3. During the sizing operation, the polymer of Example 3 forms "spot-welds" between the yarn fibers whereas the polymer of Examples 1 or 2 apparently migrates to the outer surfaces of the "spot-welds", yielding a hard, non-tacky shell.

The inventive blend compositions are compared with the commercial products Permaloid 150 and Permaloid 172, both manufactured by Rhône-Poulenc Inc. for use as textile sizes. All samples are evaluated at concentrations of 7% and applied to polyester filament yarn via a lab scale slasher. The abrasion resistance of the latex blends is approximately equal to that of Permaloid 150 and Permaloid 172. The advantage rendered by use of the inventive latex blends is the absence of neutralization prior to application. Conventional sizes, such as Permaloid 150 and Permaloid 172 are applied as solution polymers prepared by the alkali induced solubilization of a conventional latex polymer. The inventive ultrafine latex based textile sizes are applied directly to the yarn without neutralization. This eliminates the need for alkali or the monitoring of ammonia release normally associated with the sizing of filament yarns and hence provides significant advantages as compared to commercially available materials.

Having described the invention in detail and by reference to the preferred embodiments thereof, it will be apparent that modifications and variations are possible without departing from the scope of the appended claims.

What is claimed is:

1. A textile sizing composition comprising two aqueous-based dispersions containing between about 15 and about 50 percent by weight solids wherein said solids comprise one or more polymers derived from one or more ethylenically unsaturated monomers selected from the group consisting of (meth)acrylic based acids and esters, acrylonitrile, styrene, divinylbenzene, vinyl acetate, ethylenically unsaturated carboxylic acids, butadiene, acrylamide, methacrylamide, vinylidene chloride, vinyl chloride and mixtures thereof, said solids having an average particle size of less than 100 nanometers and wherein the glass transition temperature of the polymer of the first dispersion is less than −25° C. and the glass transition temperature of the polymer of the second dispersion is greater than −10° C.

2. The textile sizing composition according to claim 1 comprising between about 30 and about 90 percent of the first dispersion and between about 10 and about 70 percent of the second dispersion.

3. The textile sizing composition according to claim 2 wherein the solids of said first dispersion are derived from butyl acrylate and acrylic acid.

4. The textile sizing composition according to claim 2 wherein the solids of said second dispersion are derived from methyl methacrylate and methacrylic acid.

* * * * *